US006890414B2

(12) United States Patent
Dickinson et al.

(10) Patent No.: US 6,890,414 B2
(45) Date of Patent: May 10, 2005

(54) PURIFICATION SYSTEM AND METHOD

(75) Inventors: Colin John Dickinson, San Jose, CA (US); Ray Carnahan, Pleasanton, CA (US)

(73) Assignee: The BOC Group, Inc., Murray Hill, NJ (US)

( * ) Notice: Subject to any disclaimer, the term of this patent is extended or adjusted under 35 U.S.C. 154(b) by 344 days.

(21) Appl. No.: 09/944,370

(22) Filed: Sep. 4, 2001

(65) Prior Publication Data

US 2003/0042143 A1 Mar. 6, 2003

(51) Int. Cl.[7] ..... C25D 21/06

(52) U.S. Cl. ..... 205/98; 205/99; 205/101; 204/232; 204/237; 204/157.15

(58) Field of Search ..... 204/232, 237, 204/157.15; 205/98, 99, 101

(56) References Cited

U.S. PATENT DOCUMENTS

| | | | |
|---|---|---|---|
| 389,427 A | | 9/1888 | Wells et al. |
| 551,361 A | | 12/1895 | Browne et al. |
| 2,487,399 A | | 11/1949 | Thurber |
| 2,606,870 A | | 8/1952 | Pemberton et al. |
| 3,649,509 A | | 3/1972 | Morawetz et al. |
| 3,945,918 A | | 3/1976 | Kirk |
| 4,006,072 A | | 2/1977 | Takayasu |
| 4,025,426 A | | 5/1977 | Anderson et al. |
| 4,090,530 A | | 5/1978 | Lange |
| 4,154,685 A | | 5/1979 | Marcotte |
| 4,171,255 A | | 10/1979 | Tuznik et al. |
| 4,289,729 A | | 9/1981 | Myers et al. |
| 4,317,733 A | | 3/1982 | Xhonneux |
| 4,728,441 A | | 3/1988 | King |
| 5,192,418 A | | 3/1993 | Hughes et al. |
| 5,298,168 A | | 3/1994 | Guess |
| 5,302,298 A | | 4/1994 | Leitzke |
| 5,391,285 A | | 2/1995 | Lytle et al. |
| 6,001,189 A | | 12/1999 | Rolfson |
| 6,096,222 A | | 8/2000 | Wurzburger et al. |
| 6,113,769 A | | 9/2000 | Uzoh et al. |
| 6,126,816 A | | 10/2000 | Ruiz, Jr. |
| 6,200,436 B1 | | 3/2001 | Mei-Chu Woo |
| 6,299,753 B1 | * | 10/2001 | Chao et al. ..... 205/157 |
| 6,391,209 B1 | * | 5/2002 | Belongia et al. ..... 210/748 |

FOREIGN PATENT DOCUMENTS

| | | |
|---|---|---|
| EP | 2 001 101 A | 1/1979 |
| FR | 2 455 640 | 5/1980 |

* cited by examiner

*Primary Examiner*—Roy King
*Assistant Examiner*—Lois Zheng
(74) *Attorney, Agent, or Firm*—David A. Hey

(57) ABSTRACT

A system for use with a plating cell configured to plate objects in a plating process. At least one byproduct is created in a plating substance used in the plating cell. The system includes a purification system configured to remove at least a portion of the at least one byproduct from the plating substance. The purification system comprises at least a first processing vessel, a second processing vessel, and a flow path providing flow from the first processing vessel to the second processing vessel. The flow path may be configured such that the flow from the first vessel to the second vessel is caused by gravity. A method is also provided for removing at least a portion of at least one byproduct from a plating substance used in a plating cell.

73 Claims, 1 Drawing Sheet

PURIFICATION SYSTEM AND METHOD

DESCRIPTION OF THE INVENTION

1. Field of the Invention

The present invention relates to a system and method that could be used in association with plating of objects. More particularly, the present invention relates to a system and method for removing at least one byproduct product produced during plating of objects.

2. Background of the Invention

Semiconductor chips are typically manufactured in a process involving the plating of metal components onto wafers. Due to a recent shift toward copper interconnect technology, plating techniques are being developed for plating wafers with copper material. Current copper plating processes, however, require costly consumable substances and generate a relatively significant amount of waste material that is costly to dispose and presents a number of environmental concerns.

In one conventional copper plating technique, wafers are plated in a cell filled with plating substances including both inorganic and organic additives. The inorganic additives include copper sulfate, sulfuric acid, water, and possibly hydrochloric acid.

Generally, the organic additives are categorized as either suppressors or accelerators, depending on their role in the electroplating process. As their names imply, suppressors act to impede the deposition of metallic copper on the cathodic surface, while accelerators enhance the deposition. Suppressors can be further characterized as either carriers or levelers. The suppressors are generally polymeric surfactants. In the case of carriers, they form a mono-layer at the cathode which offers a diffusion barrier to cupric ions, and enhances cathodic polarization needed for fine grain structure. Levelers are typically multiple-charged and adhere preferentially to highly charged areas such as corners and edges, and thus prevent overhanging at trench mouths. The large size of levelers impedes their migration into trenches, which in turn impedes conformal filling and allows for better bottom-up filling.

As mentioned above, organic additives also include accelerators. These substances are usually unsaturated compounds containing a polar sulfur, oxygen, or nitrogen functional group. They adsorb strongly and uniformly on seed surfaces, promoting dense nucleation and, consequently growth of fine grains. This leads to a uniformly smooth, well-textured (i.e. bright) finish. Accordingly, accelerators are often referred to as brighteners.

During a plating process, organic additives break down, with the accelerators generally tending to break down more rapidly than suppressors. In a simplified approach, it has been estimated that at least one commercially available plating chemistry has accelerator agents with a stoichiometric breakdown rate estimated at 2 mg/amp-hr while its suppressor agents break down at a rate of 10 mg/amp-hr.

Since organic materials break down during plating, a substantially continuous plating process requires some way of controlling levels of the organic additives in the plating cell. In addition, there is a need to control the levels of byproducts that are generated as a result of the breakdown of the organic additives.

The simplest approach to controlling levels of organic additives and their byproducts involves batch processing where a plating cell is initially filled with fresh plating substances and plating of wafers continues until the results become unacceptable. Then, the entire contents of the cell are drained and the cell is refilled again with fresh plating substances. This generates large quantities of waste, which must be treated because the waste contains relatively large amounts of copper and acid. Since this batch processing does not have direct control over the chemistry of the plating bath, a number of potentially reusable components from the drained cell are disposed without being reused.

Another approach to controlling organic additives and their byproducts is referred to as the "bleed and feed" approach. In bleeding and feeding, fresh plating substances are continuously added to the plating cell at a continuous flow rate while a portion of the contents are continuously drained from the cell at a constant flow rate and then disposed without being reused. Although this approach is slightly more sophisticated than the batch approach, both methods lead to substantially the same amount of waste generated over time. For example, the amount of waste could range from 10 cc/wafer to 25 cc/wafer at high wafer plating rates. In addition, while the bleed and feed approach does remove some of the contaminants associated with the break down of the organic additives, it does not completely remove them, and only dilutes them somewhat to a generally steady-state concentration. Over a period of time, the accumulation of the byproducts requires a complete draining of the plating cell and subsequent refilling.

In one very recent proposed approach that attempts to deal with this significant amount of waste produced in the plating process, used plating substance is removed from a plating cell and passed through a byproduct removal arrangement to remove byproducts in the plating substance, and then an additive device may be used to replace the organic substances that were broken down during the plating process. To provide effective byproduct removal, the byproduct removal arrangement for such a proposed system could have a plurality of processing devices flow coupled together with a relatively complicated piping, pumping, and/or valving configuration. Such a complicated flow coupling might prevent backflow of the plating substance in the byproduct removal arrangement, but this structure might increase both the cost to purchase the arrangement and the cost to operate it.

In light of the foregoing, there is a need in the art for improving systems and methods associated with object plating.

SUMMARY OF THE INVENTION

Accordingly, the present invention is directed to a system and method that may obviate one or more of the limitations of the related art. In particular, the present invention could be directed to systems and methods that might be used in object plating associated with forming semiconductor wafers. The invention, in its broadest sense, however, could be used for plating of a wide variety of different substances onto a variety of different objects.

In one aspect, the present invention includes a system for use with a plating cell configured to plate objects in a plating process. At least one byproduct is created in a plating substance used in the plating cell. In one system according to the invention, there is a purification system configured to remove at least a portion of the at least one byproduct from the plating substance. The purification system comprises at least a first processing vessel, a second processing vessel, and a flow path providing flow from the first processing vessel to the second processing vessel. In accordance with the invention, the flow path is configured such that the flow from the first vessel to the second vessel is caused by gravity.

In one aspect of the invention, the first processing vessel comprises a reacting vessel configured to remove the at least one byproduct. The reacting vessel may be configured to supply at least one gas, such as ozone, in the reacting vessel to react with the at least one byproduct. In addition, the reacting vessel may be configured to supply ultraviolet light in the reacting vessel to increase the reaction between the at least one byproduct and the gas, for example.

In a further aspect of the invention, the second processing vessel may be a degassing vessel configured to remove gas in the plating substance. For example, the degassing vessel may be configured to supply at least one second gas, such as nitrogen, to accelerate the removal of gaseous byproducts in the plating substance.

In another aspect of the invention, the first processing vessel includes an inlet near its top and an outlet near its bottom. The second processing vessel includes an inlet near its top and the inlet of the second processing vessel is lower than the inlet of the first processing vessel. For example, the inlet of the second processing vessel may range from about 0.5 inches to about 10 inches lower than the inlet of the first processing vessel.

In yet another aspect of the invention, the purification system may include a third processing vessel interposed between the first processing vessel and the second processing vessel. Furthermore, each of the first and third processing vessels may comprise a reacting vessel configured to remove a portion of the at least one byproduct from the plating substance. For example, the reacting vessel of at least one of the first and third processing vessels may be configured to supply at least one gas, such as ozone, in the reacting vessel to react with the at least one byproduct. In addition, at least one of the reacting vessels maybe configured to supply ultraviolet light to increase the reaction between the at least one byproduct and the gas.

In a further aspect, each of the first and third processing vessels may include an inlet near its top and an outlet near its bottom, and the second processing vessel may include an inlet near its top. In this arrangement, the inlet of the second processing vessel may be lower than the inlets of the first and third processing vessels. Furthermore, the inlets of the first and third processing vessels may be at substantially the same height.

In yet another aspect, the first and second processing vessels may be operated at atmospheric pressure.

In accordance with another aspect of the invention, the purification system includes a first processing vessel having an inlet near its top and an outlet near its bottom, and a second processing vessel having an inlet near its top. The second processing vessel may be arranged such that the inlet of the second processing vessel is lower than the inlet of the first processing vessel. The purification system also includes a flow path providing flow from the outlet of the first processing vessel to the inlet of the second processing vessel.

In a further aspect of the invention, the purification system includes a third processing vessel interposed between the first processing vessel and the second processing vessel. The third processing vessel includes an inlet near its top and an outlet near its bottom. The outlet of the first processing vessel is flow connected to the inlet of the third processing vessel and the outlet of the third processing vessel is flow connected to the inlet of the second processing vessel.

In accordance with another aspect, the system is configured to withdraw at least a portion of the plating substance used in the plating cell, to remove at least a portion of the at least one byproduct, and to return at least a portion of the plating substance to the plating cell. The system may include a tank for storing the plating substance used in the plating cell and a purification system.

In a further aspect, the system includes a pump for withdrawing at least a portion of the plating substance from the tank.

In another aspect, the system includes a return pump for returning at least a portion of the plating substance to the tank.

In yet another aspect, the purification system includes a level detector associated with the second processing vessel and the return pump is controlled based on a level detected by the level detector. Alternatively, the level detector could control the pump for withdrawing at least a portion of the plating substance from the tank, rather than the return pump, or could control both pumps based on a level detected by the level detector.

The invention also includes a method for removing at least a portion of at least one byproduct from a plating substance used in a plating cell. The method includes flowing a used plating substance from the plating cell to a purification system configured to remove at least a portion of at least one byproduct from the used plating substance. The purification system comprises at least a first processing vessel, a second processing vessel, and a flow path providing flow from the first processing vessel to the second processing vessel. The flow path is configured such that the flow from the first vessel to the second vessel is caused by gravity. The method further includes passing the used plating substance from the first to the second processing vessel by gravity, and removing at least a portion of the at least one byproduct from the used plating substance in at least one of the first and second processing vessels.

In another aspect of the method, the first processing vessel comprises a reacting vessel configured to remove the portion of the at least one byproduct, and the method further comprises supplying at least one gas within the reacting vessel such that the at least one byproduct reacts with the gas.

In a further aspect, the method includes applying ultraviolet light to the used plating substance within the reacting vessel to increase the amount of reaction between the gas and the at least one byproduct.

In another aspect of the method, the second processing vessel includes a degassing vessel configured to remove the gas remaining in the used plating substance and the method includes supplying at least one second gas to the used plating substance within the degassing vessel such that the second gas facilitates degassing of the used plating substance.

In still another aspect of the method, the passing includes passing the used plating substance from an outlet of the first processing vessel to an inlet of the second processing vessel by gravity.

In a further aspect of the method, the flowing includes conveying the used plating substance from a storage tank to the purification system. For example, the conveying may include pumping the used plating substance from the storage tank to the purification system.

In another aspect, the method further includes detecting the level of the used plating substance in the second processing vessel and adjusting the pumping of the used plating substance from the storage tank to the purification system based on the detected level.

In another aspect, the method may include pumping the used plating substance from the purification system to the tank with a return pump. The method may also include detecting the level of the used plating substance in the second processing vessel and adjusting the return pump based on the detected level. For example, the adjusting may maintain the used plating substance at a predetermined level in the second processing vessel.

In another aspect of the method, the purification system may include a third processing vessel interposed between the first and second processing vessels. Passing may include passing the used plating substance through the third processing vessel.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an exemplary embodiment of the invention and together with the description, serve to explain the principles of the invention. In the drawings.

DESCRIPTION OF THE EMBODIMENTS

Reference will now be made in detail to the exemplary embodiments of the invention, an example of which is illustrated in the accompanying drawings. Wherever possible, the same reference numbers will be used throughout the drawings to refer to the same or like parts.

Figure 1:
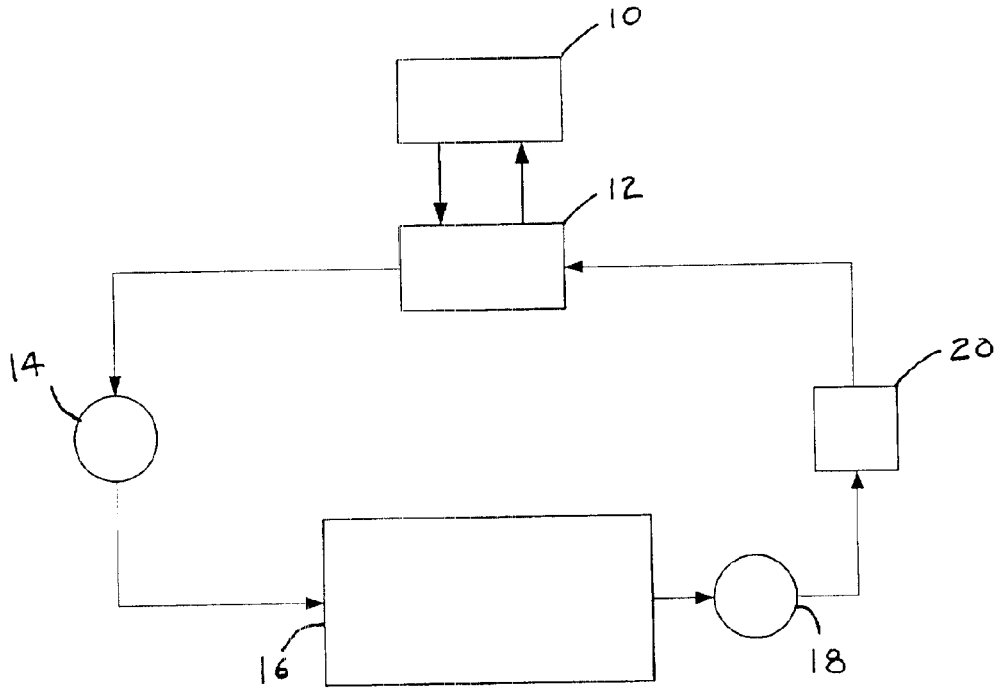
FIG. 1 is a schematic view of a plating arrangement in accordance with an exemplary embodiment of the invention wherein solid lines represent fluid couplings.

In accordance with the invention, there is provided a system for use with a plating cell. As shown in FIG. 1, a plating cell 10 is associated with an exemplary embodiment of a system including a tank 12, a pump 14, a purification system 16, a return pump 18, and a component combiner 20.

The plating cell 10 may be any conventional plating cell used to plate objects in a plating process. For example, the plating cell may be used to plate copper onto wafers to form semiconductor wafers, however, the invention is not limited to this specific plating arrangement.

As a result of the plating process, at least one byproduct is created in the plating substance used in the plating cell. For example, in one plating process, the plating cell 10 may be in direct flow communication with the tank 12. Plating substance is withdrawn from the tank 12, used in the plating cell 10, and then returned to the tank 12. During this process, the plating substance, which may include both inorganic and organic substances, may become contaminated with one or more byproducts as reactions occur in the plating cell 10. In addition, further breakdown of the plating substance in the tank may occur, thereby resulting in increased levels of byproducts.

The pump 14 may be configured to withdraw a portion of the plating substance from the tank 12 and provide flow communication between the tank 12 and purification system 16. The pump 14 may be any suitable pump for withdrawing a portion of the plating substance from the tank. In one exemplary arrangement, the pump 14 provides a flow rate of up to about 250 milliliters per minute. One such pump is available from Iwaki Walchen and is identified as EHC30 Series Electronic Metering Pump. Other pumps having different flow rates may work as well.

As explained in more detail below, the purification system 16 is configured to remove one or more byproducts from plating substances pumped from the tank 12.

The return pump 18 is configured to pump plating substance from the purification system 16 to the tank 12. In one exemplary arrangement, pump 14 and return pump 18 may be the same type of pump. This may allow the pumps 14, 18 to be operated at substantially the same rate to maintain a desired level of plating substance in the tank 12.

Both of the pumps 14, 18 may be provided in a cabinet (not shown) to limit any spills of the plating substances during pumping. Such a pump-containing cabinet could be positioned near tank 12 at a vertical limit consistent with the pumping capabilities of the pumps 14, 18. For example, the above-mentioned pump from Iwaki Walchen has the ability to pump fluid to a height of at least about five feet, and therefore, such a pump could be located about 5 feet or less above the height of the plating substance in the tank. Other pumps may have different pumping capabilities and could be positioned accordingly.

The cabinet and return pump 18 could be located anywhere downstream from the purification system 16.

As seen in FIG. 1, a component combiner 20 may be located downstream from the purification system 16. The component combiner 20 may be used to add appropriate amounts of inorganic and/or organic substances to the plating substance to replace those inorganic and/or substances lost during the plating process and optionally also during the purification process. After passing through the component combiner 20, the plating substance is returned to the tank 12.

Although the exemplary embodiment shown in FIG. 1, includes the tank 12, pump 14, return pump 18, and component combiner 20, the invention is not limited to this embodiment. The invention may be practiced without one or more of the foregoing structures. For example, in its broadest sense, the invention may be practiced with just the purification system 16.

Figure 2:
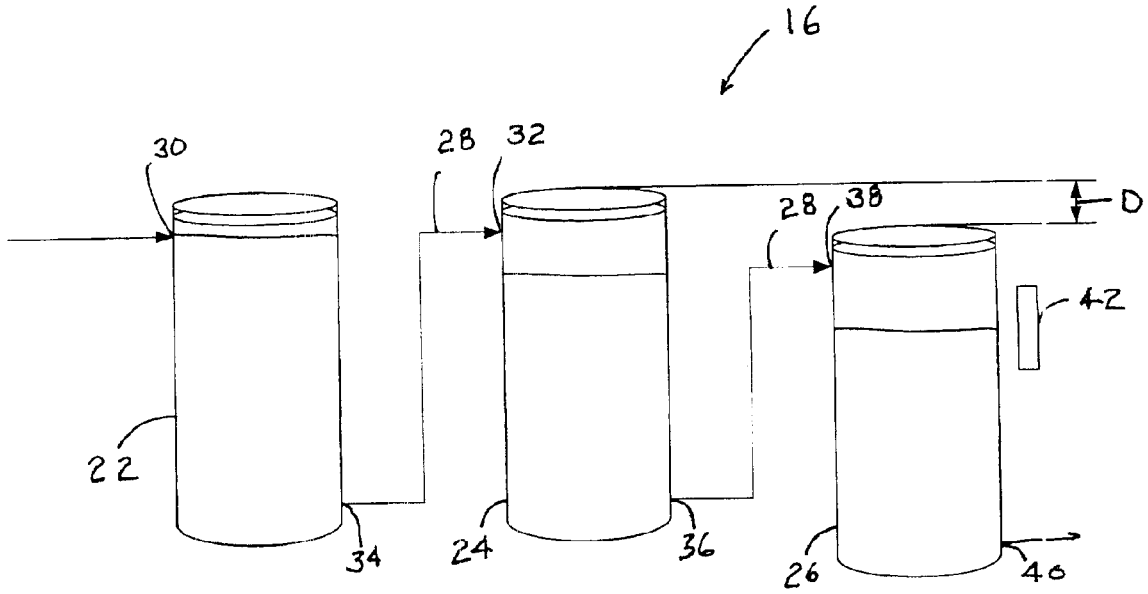
FIG. 2 is a schematic view of a purification system shown in FIG. 1, wherein solid lines represent fluid couplings.

FIG. 2 shows an example of the purification system 16 that could be associated with the arrangement of FIG. 1. As shown in FIG. 2, the purification system 16 is configured to remove at least a portion of at least one byproduct from the plating substance and includes at least a first processing vessel and a second processing vessel. In the exemplary embodiment shown in FIG. 2, there is optionally also a third processing vessel interposed between the first processing vessel and second processing vessel, and the first and third processing vessels are reacting vessels 22, 24, respectively, while the second processing vessel is a degassing vessel 26. There could be any number of additional vessels and the vessels could be configured in any known manner to enable removal of one or more byproducts.

The purification system 16 also includes a flow path 28 which allows flow of the plating substance from reacting vessel 22 to degassing vessel 26 via the reacting vessel 24. In the exemplary embodiment, the flow is caused by gravity. This arrangement will be described below.

Each of the reacting vessels 22, 24 may be configured to remove a portion at least one of the byproducts from the plating substance. For example, each of the reacting vessels 22, 24 may be configured to supply at least one gas, such as ozone, in the respective vessel to react with one or more byproducts in the plating substance. In addition, each reacting vessel 22, 24 may be configured to supply ultraviolet light in the respective reacting vessel to assist in increasing the reaction between the gas and the byproduct(s). Each reacting vessel 22, 24 may also include a vent to collect all the gases released from the plating substance in the reaction vessel. Although each of the reacting vessels has been described as being configured to supply both gas(es) and ultraviolet light, the gas(es) and ultraviolet light may be provided in separate reacting vessels. Furthermore, different purification processes may be performed in the processing vessels, such as the addition of hydrogen peroxide to remove organic byproducts, for example.

The degassing vessel 26 is configured to remove one or more gases in the plating substance. The gas removed in the degassing vessel 26 may be gas(es) introduced in the reaction vessels 22, 24 or from sources other than the reacting vessels. One approach to removing the gas(es) is to supply at least one second gas to react with the gas in the plating substance. For instance, nitrogen gas may be released in the degassing vessel 26 to cause removal of gas(es) previously supplied by the reacting vessels 22, 24. After a substantially amount of the gas is removed, the plating substance may then be returned to either the tank 12 or plating cell 10.

The configuration of the reacting vessels 22, 24, the degassing vessel 26, and the flow path 28 allows the plating substance to flow from the reacting vessel 22 to the degassing vessel 26 via the reacting vessel 24. Each of the reacting vessels 22, 24 includes a respective inlet 30, 32 near its top and a respective outlet 34, 36 near its bottom. Similarly, the degassing vessel 26 includes an inlet 38 near its top and an outlet 40 near its bottom. In the exemplary embodiment shown, the inlet 30 of reacting vessel 22 is in flow communication with the tank 12; the outlet 34 of reacting vessel 22 is in flow communication with the inlet 32 of reacting vessel 24; the outlet 36 of the reacting vessel 24 is in flow communication with the inlet 38 of the degassing vessel 26; and the outlet 40 of the degassing vessel 26 is in flow communication with the tank 12. In this arrangement, the flow of plating substance from reacting vessel 22 to reacting vessel 24 and from reacting vessel 24 to degassing vessel 26 is assisted by gravity. In the exemplary embodiment, this arrangement could enable the processing vessels to be operated at atmospheric pressure and optionally also obviate any valving, pumping, and other flow controls between the vessels.

One approach to providing the gravity feeding is also shown in FIG. 2. The inlets 30, 32 are shown as being at substantially the same vertical height, while the inlet 38 of the degassing vessel 26 is vertically lower than the inlets 30, 32. Preferably, the difference D in vertical height between the inlet 38 and the inlets 30, 32 ranges from about 0.5 inches to about 10 inches. In one exemplary embodiment, the difference D is about 1 inch. There are several different ways of providing the vertical height difference D. For example, where the processing vessels have substantially the same general inlet construction, the degassing vessel 26 could be mounted on a platform having a vertical height difference D shorter than a platform on which the reacting vessels 22, 24 are mounted. Alternatively, the reacting vessels 22, 24, 26 could be mounted on the same surface and the inlet 38 of the degassing vessel 26 can be formed at a location having a vertical height difference D lower than the location of the inlets 30, 32 of the reacting vessels 22, 24.

By arranging the inlet 38 to have a vertical height difference D below the inlets 30, 32, the level of plating substance in reacting vessel 24 can be kept at a predetermined level below the opening of the inlet 32. This will allow plating substance in reacting vessel 22 to flow into reacting vessel 24. Even though FIG. 2 shows the inlets 30, 32 of the reacting vessels 22, 24 as being the same height, it is understood that inlet 32 could be slightly lower than inlet 30, while still having the inlet 38 having a height difference D lower than at least the inlet 32.

As shown in FIG. 2, a level detector 42 could be associated with the degassing vessel 26. The return pump 18 (FIG. 1) may be controlled based on the level of plating substance detected by the level detector 42 in the degassing vessel 26. For example, if the plating substance in the degassing vessel 26 were to approach the inlet 38 of the degassing vessel 26, the pumping rate of the return pump 18 may be increased to lower the level of plating substance in the degassing vessel 26. In this manner, a predetermined level could be controlled in the degassing vessel 26. Alternatively, the pump 14 (FIG. 1), rather than the return pump 18, or both pumps 14,18 may be controlled based on the level of plating substance detected by the level detector 42 in the degassing vessel 26.

The system could be used in a method for removing at least a portion of at least one byproduct from a plating substance used in the plating cell 10. In one exemplary method, used plating substance is flowed to purification system 16 as described above. The used plating substance is passed from the first processing vessel (e.g., reaction vessel 22) to the second processing vessel (e.g., degassing vessel 26) via the third processing vessel (e.g., reaction vessel 24) by gravity. And a portion of at least one byproduct is removed from the used plating substance in at least one of the first, second, and third processing vessels.

Flowing the used plating substance to the purification system 16 may be accomplished by conveying used plating substance from the tank 12 to the purification system 16. For example, the conveying may be performed by pumping the used plating substance to the purification system 16 using the pump 14.

After removing at least a portion of at least one byproduct from the used plating substance, the return pump 18 could return used plating substance to the tank 12 after pumping the used plating substance through the component combiner 20.

The method may also include detecting the level of plating substance in the second processing vessel (e.g., degassing vessel 26) and adjusting the return pump 18 based on the detected level. The adjustment of the return pump 18 may be controlled to maintain the used plating substance at a predetermined level in the second processing vessel (e.g., degassing vessel 26). Alternatively, the method may include adjusting the pump 14, rather than the return pump 18, or both pumps 14, 18 based on the detected level.

In one exemplary method, at least one gas is supplied within the reaction vessel 22 such that at least a portion of the at least one byproduct reacts with the gas. The reaction vessel 22 may also be used to apply ultraviolet light to the used plating substance within the reacting vessel 22 to increase the amount of reaction between the gas and the at least one byproduct.

In addition, the method could include supplying at least one second gas to the used plating substance within the degassing vessel 26 such that the second gas degasses the used plating substance.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system for use with a plating cell configured to plate objects in a plating process wherein at least one byproduct is created in a plating substance used in the plating cell, the system comprising:

a purification system configured to remove at least a portion of the at least one byproduct from the plating substance, wherein the purification system comprises at least a first processing vessel, a second processing vessel, and a flow path providing flow from the first processing vessel to the second processing vessel, wherein the flow path is configured such that the flow from the first vessel to the second vessel is caused by gravity, wherein at least one of the first processing vessel and the second processing vessel is configured to remove at least a portion of the at least one byproduct from the used plating substance.

2. The system according to claim 1, wherein the first processing vessel comprises a reacting vessel configured to remove said at least a portion of the at least one byproduct.

3. The system according to claim 2, wherein the reacting vessel is configured to supply at least one gas in the reacting vessel to react with the at least one byproduct.

4. The system according to claim 3, wherein the gas comprises ozone.

5. The system according to claim 3, wherein the reacting vessel is configured to supply ultraviolet light in the reacting vessel.

6. The system according to claim 3, wherein the second processing vessel is a degassing vessel configured to remove gas in the plating substance.

7. The system according to claim 6, wherein the degassing vessel is configured to supply at least one second gas to facilitate degassing of the plating substance.

8. The system according to claim 7, wherein the second gas comprises nitrogen.

9. The system according to claim 1, wherein the first processing vessel includes an inlet near its top and an outlet near its bottom, wherein the second processing vessel includes an inlet near its top, and wherein the inlet of the second processing vessel is lower than the inlet of the first processing vessel.

10. The system according to claim 9, wherein the inlet of the second processing vessel ranges from about 0.5 inches to about 10 inches lower than the inlet of the first processing vessel.

11. The system according to claim 1, wherein the purification system includes a third processing vessel interposed between the first processing vessel and the second processing vessel.

12. The system according to claim 11, wherein each of the first and third processing vessels comprises a reacting vessel configured to remove said at least a portion of the at least one byproduct from the plating substance.

13. The system according to claim 12, wherein the reacting vessel of at least one of the first and third processing vessels is configured to supply at least one gas to react with the at least one byproduct.

14. The system according to claim 13, wherein the gas comprises ozone.

15. The system according to claim 13, wherein at least one of the reacting vessels is configured to supply ultraviolet light to increase the reaction between the at least one byproduct and the gas.

16. The system according to claim 13, wherein the second processing vessel is a degassing vessel configured to remove gas in the plating substance.

17. The system according to claim 16, wherein the degassing vessel is configured to supply at least one second gas to facilitate degassing of the plating substance.

18. The system according to claim 17, wherein the second gas comprises nitrogen.

19. The system according to claim 11, wherein each of the first and third processing vessels includes an inlet near its top and an outlet near its bottom, wherein the second processing vessel includes an inlet near its top, and wherein the inlet of the second processing vessel is lower than the inlets of the first and third processing vessels.

20. The system according to claim 19, wherein the inlets of the first and third processing vessels are at substantially the same height.

21. The system according to claim 20, wherein the inlet of the second processing vessel ranges from about 0.5 inches to about 10 inches lower than the inlets of the first and third processing vessels.

22. The system according to claim 1, wherein the first and second processing vessels are operated at atmospheric pressure.

23. A system for use with a plating cell configured to plate objects in a plating process wherein at least one byproduct is created in a plating substance used in the plating cell, the system being configured to withdraw at least a portion of the plating substance used in the plating cell, to remove at least a portion of the at least one byproduct, and to return at least a portion of the plating substance to the plating cell, the system comprising:

a tank for containing the plating substance used in the plating cell; and a purification system according to claim 1.

24. The system according to claim 23, further comprising a pump for withdrawing at least a portion of the plating substance from the tank.

25. The system according to claim 23, further comprising a return pump for returning at least a portion of the plating substance to the tank.

26. The system according to claim 25, wherein the purification system includes a level detector associated with the second processing vessel and wherein the return pump is controlled based on a level detected by the level detector.

27. The system according to claim 23, wherein the purification system includes a third processing vessel interposed between the first and second processing vessels.

28. The system according to claim 27, wherein each of the first and third processing vessels comprises a reacting vessel configured to remove said at least a portion of the at least one byproduct from the plating substance.

29. The system according to claim 28, wherein the reacting vessel of at least one of the first and third processing vessels is configured to supply at least one gas to react with the at least one byproduct.

30. The system according to claim 29, wherein the gas comprises ozone.

31. The system according to claim 29, wherein at least one of the reacting vessels is configured to supply ultraviolet light to react with the at least one byproduct and the gas.

32. The system according to claim 29, wherein the second processing vessel is a degassing vessel configured to remove gas in the plating substance.

33. The system according to claim 32, wherein the degassing vessel is configured to supply at least one second gas to facilitate degassing of the plating substance.

34. The system according to claim 33, wherein the second gas comprises nitrogen.

35. The system according to claim 28, wherein each of the first and third processing vessels includes an inlet near its top and an outlet near its bottom, wherein the second processing vessel includes an inlet near its top, and wherein the inlet of the second processing vessel is lower than the inlets of the first and third processing vessels.

36. The system according to claim 35, wherein the inlets of the first and third processing vessels are at substantially the same height.

37. The system according to claim 36, wherein the inlet of the second processing vessel ranges from about 0.5 inches to about 10 inches lower than the inlets of the first and third processing vessels.

38. A system for use with a plating cell configured to plate objects in a plating process wherein at least one byproduct is created in a plating substance used in the plating cell, the system comprising:

a purification system configured to remove at least a portion of the at least one byproduct from the plating substance, wherein the purification system comprises at least a first processing vessel, wherein the first processing vessel includes an inlet near its top and an outlet near its bottom, a second processing vessel, wherein the second processing vessel includes an inlet near its top, and wherein the second processing vessel is arranged such that the inlet of the second processing vessel is lower than the inlet of the first processing vessel, and a flow path providing flow from the outlet of the first processing vessel to the inlet of the second processing vessel.

39. The system according to claim 38, wherein the first processing vessel comprises a reacting vessel configured to remove said at least a portion of the at least one byproduct, wherein the reacting vessel is configured to supply at least one gas in the reacting vessel to react with the at least one byproduct.

40. The system according to claim 39, wherein the reacting vessel is configured to supply ultraviolet light in the reacting vessel.

41. The system according to claim 39, wherein the second processing vessel comprises a degassing vessel configured to remove gas in the plating substance.

42. The system according to claim 38, wherein the inlet of the second processing vessel ranges from about 0.5 inches to about 10 inches lower than the inlet of the first processing vessel.

43. The system according to claim 38, wherein the purification system includes a third processing vessel interposed between the first processing vessel and the second processing vessel, wherein the third processing vessel includes an inlet near its top and an outlet near its bottom, wherein the outlet of the first processing vessel is flow connected to the inlet of the third processing vessel, and the outlet of the third processing vessel is flow connected to the inlet of the second processing vessel.

44. The system according to claim 43, wherein at least one of the first and third processing vessels comprises a reacting vessel configured to supply at least one gas to react with the at least one byproduct.

45. The system according to claim 44, wherein the reacting vessel is configured to supply ultraviolet light.

46. The system according to claim 45, wherein the second processing vessel comprises a degassing vessel configured to remove gas in the plating substance.

47. The system according to claim 46, wherein the inlet of the second processing vessel ranges from about 0.5 inches to about 10 inches lower than the inlets of the first and third processing vessels.

48. A system for use with a plating cell configured to plate objects in a plating process wherein at least one byproduct is created in a plating substance used in the plating cell, the system being configured to withdraw at least a portion of the plating substance used in the plating cell, to remove at least a portion of the at least one byproduct, and to return at least a portion of the plating substance to the plating cell, the system comprising:

a tank for containing the plating substance used in the plating cell; and a purification system according to claim 38.

49. The system according to claim 48, further comprising a pump for withdrawing at least a portion of the plating substance from the tank.

50. The system according to claim 48, further comprising a return pump for returning at least a portion of the plating substance to the tank.

51. The system according to claim 50, wherein the purification system includes a level detector associated with the second processing vessel and wherein the return pump is controlled based on a level detected by the level detector.

52. The system according to claim 48, wherein the purification system includes a third processing vessel interposed between the first and second processing vessels, wherein the third processing vessel includes an inlet near its top and an outlet near its bottom, wherein the outlet of the first processing vessel is flow connected to the inlet of the third processing vessel and the outlet of the third processing vessel is flow connected to the inlet of the second processing vessel.

53. A method for removing at least a portion of at least one byproduct from a plating substance used in a plating cell, the method comprising:

flowing a used plating substance from the plating cell to a purification system configured to remove at least a portion of at least one byproduct from the used plating substance, wherein the purification system comprises at least a first processing vessel, a second processing vessel, and a flow path providing flow from the first processing vessel to the second processing vessel, wherein the flow path is configured such that the flow from the first processing vessel to the second processing vessel is caused by gravity;

passing the used plating substance from the first processing vessel to the second processing vessel by gravity; and removing at least a portion of the at least one byproduct from the used plating substance in at least one of the first and second processing vessels.

54. The method according to claim 53, wherein the first processing vessel comprises a reacting vessel configured to remove said at least a portion of the at least one byproduct, and wherein the method further comprises supplying at least one gas within the reacting vessel such that said at least a portion of the at least one byproduct reacts with the gas.

55. The method according to claim 54, further comprises applying ultraviolet light to the used plating substance within the reacting vessel to increase the amount of reaction between the gas and said at least a portion of the at least one byproduct.

56. The method according to claim 54, wherein the second processing vessel comprises a degassing vessel configured to remove gas in the used plating substance, and the method further comprises supplying at least one second gas to the used plating substance within the degassing vessel such that the second gas facilitates degassing of the used plating substance.

57. The method according to claim 53, wherein the first processing vessel includes an inlet near its top and an outlet near its bottom, wherein the second processing vessel includes an inlet near its top, wherein the inlet of the second processing vessel is lower than the inlet of the first processing vessel, and wherein the passing comprises passing the used plating substance from the outlet of the first processing vessel to the inlet of the second processing vessel by gravity.

58. The method according to claim 53, wherein the flowing comprises conveying the used plating substance from a storage tank to the purification system.

59. The method according to claim 58, wherein the conveying comprises pumping the used plating substance from the storage tank to the purification system.

60. The method according to claim 58, further comprising pumping the used plating substance from the purification system to the tank with a return pump.

61. The method according to claim 60, further comprising detecting the level of the used plating substance in the second processing vessel and adjusting the return pump based on the detected level.

62. The method according to claim 61, wherein the adjusting maintains the used plating substance at a predetermined level in the second processing vessel.

63. The method according to claim 53, wherein the purification system includes a third processing vessel interposed between the first and second processing vessels, and wherein the passing includes passing the used plating substance through the third processing vessel.

64. The system according to claim 24, wherein the purification system includes a level detector associated with the second processing vessel and wherein the pump for withdrawing at least a portion of the plating substance is controlled based on a level detected by the level detector.

65. The system according to claim 49, wherein the purification system includes a level detector associated with the second processing vessel and wherein the pump for withdrawing at least a portion of the plating substance is controlled based on a level detected by the level detector.

66. The method according to claim 60, further comprising detecting the level of the used plating substance in the second processing vessel and adjusting the pumping based on the detected level.

67. The system according to claim 1, wherein the first processing vessel includes an inlet near its top and an outlet near its bottom, wherein the second processing vessel includes an inlet near its top, and wherein the inlet of the second processing vessel is higher than the outlet of the first processing vessel.

68. The system according to claim 38, wherein the inlet of the second processing vessel is higher than the outlet of the first processing vessel.

69. The method according to claim 53, wherein the first processing vessel includes an inlet near its top and an outlet near its bottom, wherein the second processing vessel includes an inlet near its top, and wherein the inlet of the second processing vessel is higher than the outlet of the first processing vessel.

70. The system according to claim 1, wherein the first processing vessel is configured to hold a first level of substance, wherein the second processing vessel is configured to hold a second level of substance, and wherein the second level is lower than or equal to the first level.

71. The system according to claim 38, wherein the first processing vessel is configured to hold a first level of substance, wherein the second processing vessel is configured to hold a second level of substance, and wherein the second level is lower than or equal to the first level.

72. The method according to claim 53, further comprising establishing a first level of substance in the first processing vessel and establishing a second level of substance in the second processing vessel, wherein the second level is lower than or equal to the first level.

73. The system according to claim 38, wherein at least one of the first processing vessel and the second processing vessel is configured to remove at least a portion of the at least one byproduct from the used plating substance.

* * * * *